US006439793B1

(12) United States Patent
Nishitani et al.

(10) Patent No.: US 6,439,793 B1
(45) Date of Patent: Aug. 27, 2002

(54) STIPPLING INSTRUMENT

(75) Inventors: Ichiro Nishitani, Yamatokoriyama; Akira Matsuda, Osaka; Munetoshi Koshihara; Masatoshi Yashima, both of Nara, all of (JP)

(73) Assignee: Kuretake Co., Ltd., Nara (JP)

( * ) Notice: Subject to any disclaimer, the term of this patent is extended or adjusted under 35 U.S.C. 154(b) by 0 days.

(21) Appl. No.: 09/969,818

(22) Filed: Oct. 3, 2001

(30) Foreign Application Priority Data

Oct. 3, 2000 (JP) ..... 2000-341189
Mar. 30, 2001 (JP) ..... 2000-137928

(51) Int. Cl.[7] ..... A47C 13/30
(52) U.S. Cl. ..... 401/261; 401/266; 401/198
(58) Field of Search ..... 401/261, 264, 401/266, 265, 198, 199, 263

(56) References Cited

U.S. PATENT DOCUMENTS 3,520,629 A * 7/1970 Otsuka ..... 401/199
3,610,766 A * 10/1971 Herrnring ..... 401/199
3,614,247 A * 10/1971 Otsuka ..... 401/199
4,723,859 A * 2/1988 Kitoh ..... 401/199
5,433,545 A * 7/1995 Keil ..... 401/199

* cited by examiner

*Primary Examiner*—David J. Walczak
(74) *Attorney, Agent, or Firm*—John P. White

(57) ABSTRACT

A stippling tool comprising includes a cylindrical main body defining an ink containing chamber therein, a slender ink transfer member having a proximal end portion to which ink in the ink containing chamber is supplied, and a distal end portion extending to an opening of the main body, in which ink is transferred from the proximal end portion to the distal end portion, and a porous elastic stippling member provided on the distal end portion of the ink transfer member, through which the ink permeates. The stippling member having a stippling distal end surface outwardly projecting in a curved shape, and the distal end surface being elastically deformed by a stroke pressure.

11 Claims, 2 Drawing Sheets

STIPPLING INSTRUMENT

CROSS-REFERENCE TO RELATED APPLICATIONS

This application is based upon and claims the benefit of priority from the prior Japanese Patent Applications No. 2000-341189, filed Oct. 3, 2000; and No. 2001-137928, filed Mar. 30, 2001, the entire contents of both of which are incorporated herein by reference.

BACKGROUND OF THE INVENTION

1. Field of the Invention

The present invention relates to a stippling instrument for stippling a drawing or making an accent in a character, in which ink is applied in dots successively on a stippled material.

2. Description of the Related Art

Generally, in stippling, various sizes of stippling marks, that is, dots, must be formed, and therefore various writing instruments each capable of forming a certain size of stippling mark are prepared, and the pointillist has to switch from one instrument to another depending on the size of a stippling mark required for the desired situation.

Therefore, not only a large number of writing instruments are required, which results in a great expense, but also the instruments must be switched continually one from another while stippling, which requires a lot of time and work.

BRIEF SUMMARY OF THE INVENTION

The object of the present invention is to provide a stippling instrument which can form various sizes of dots when stippling only by itself so that a lot of time and work is not necessary and the cost can be reduced.

According to an aspect of the present invention, there is provided a stippling tool comprising:

a cylindrical main body having an opening on a distal end side thereof, and defining an ink containing chamber therein;

a slender ink transfer member having a proximal end portion to which ink in the ink containing chamber is supplied, and a distal end portion extending to the opening of the main body, in which ink is transferred from the proximal end portion to the distal end portion; and a porous elastic stippling member provided on the distal end portion of the ink transfer member, through which the ink permeates;

the stippling member having a stippling distal end surface projecting in a curved shape to a direction of the distal end, and located outside from the opening of the main body, the distal end surface being elastically deformed by a stroke pressure, thereby stippling a point mark of dimensions in accordance with the stroke pressure onto an object material.

With the stippling instrument having the above-described structure, when the user holds the main body and presses the distal end surface of the stippling member against an object material for stippling, ink which has been already supplied to the stippling member from the ink storage chamber stains the object material to make a point mark on the material. During this operation, as the user changes the stroke pressure, various sizes of point marks can be made on the material in accordance with the degree of the stroke pressure. Therefore, stippling can be performed while changing the size of point mark with only one instrument, and therefore the drawbacks of the conventional instrument can be solved in terms of cost, time and operation itself.

It should be noted that the distal end surface of the stippling member may be a continuous partial spherical surface or a non-continuous partial spherical surface having a cavity of such a shape of a cross of slits.

In the latter case, not only a round point mark but also a different shape of point mark can be formed by adjusting the stroke pressure and the angle of the stippling instrument, and therefore it is possible to stipple an image of a different touch from ordinary ones.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the stippling instrument according to the present invention will now be described with reference to the accompanying drawings.

Figure 1:
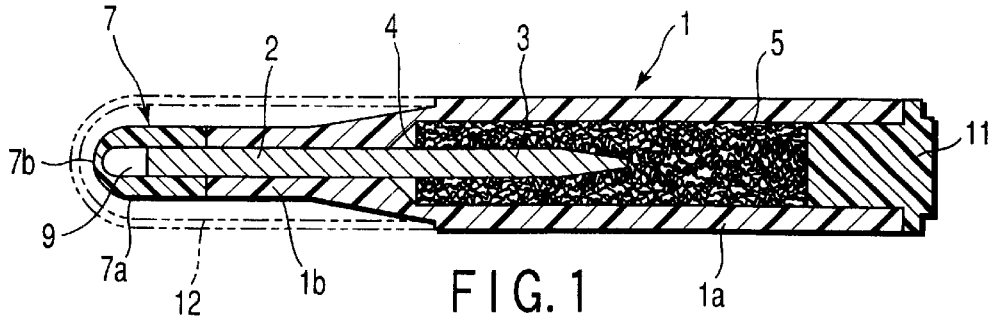
FIG. 1 is a diagram showing a cross section of a stippling instrument according to the first embodiment of the present invention.

A stippling instrument according to the first embodiment shown in FIG. 1, has a main body 1 of a slender cylindrical writing instrument which is formed of, for example, a synthesis resin integrally by molding. The main body, though it is not limited, should preferably have a cylindrical shape having a proximal end portion 1*a* having a large diameter, and a distal end portion 1*b* of a small diameter, which are connected to each other via a tapered section. An ink storage chamber defined by an inner circumferential surface of the proximal end portion is filled with an ink holding member 5 impregnated with ink. The ink holding member 5 has a structure in which ink within the member can be transferred due to capillary action. It is preferable that the member be made of a filling (cotton) material made by tightly entwining one or a plurality of slender natural strings to a predetermined density.

The inner circumferential surface of the distal end portion 1*b* defines an ink transfer member hole 2, in which a slender ink transfer member 3 is inserted such that the proximal end portion is inserted into the ink holding member 5 and the distal end portion projects from an opening at an end of the distal end portion 1*b*. The ink transfer member 3 has a structure in which ink can be transferred through the center and/or outer circumference thereof preferably due to capillary action. For example, the ink transfer member 3 is made of, for example, a great number of long fibers which are bundled together and molded into a solid form. The material of the ink transfer member may be of the same type which is used in various markers commercially available. The ink transfer member 3 is fixed so as not to move with respect to the main body 1. An appropriate method such as adhesion or fit-in, can be employed to fix the member 3. As a typical example, the ink transfer member 3 is formed to have a distal end with a large diameter, and the transfer member 3 is inserted to the transfer member hole 2 from the rear end portion thereof until the distal end of the large-diameter end portion of the member 3 is stopped by the distal end surface of the distal end portion 1*b*. Thus, both members are fixed together.

The distal end portion of the transfer member 3 is covered by a cylindrical elastic stippling member 7 made of a soft open-cell foam material such as an open-cell foam resin. The stippling member 7 includes a hollow, preferably, cylindrical peripheral portion 7*a* having both ends opened. The inner circumferential surface of the portion 7*a* and outer circumferential surface of the distal end of the ink transfer member 3 are brought into tight contact with each other or connected together with a pressure so that ink can be transferred between both surfaces. The stippling member also has a distal end portion 7*b* which covers the front side opening of the peripheral portion 7*a* and projects out forwards to have a curvature. As a result, the front surface of the distal end portion 7*b* makes a continuously curved surface. The peripheral portion and the distal end portion of the stippling member 7 may have the same thickness or they may differ in thickness. In this embodiment, the distal end portion is made thinner than the peripheral portion in order to obtain more softness, and further a cavity or an interspace 9 is created between the inner surface of the distal end portion and the distal end surface of the transfer member 3. With this structure, the distal end portion 7*b* of the stippling member 7 is made elastically deformable in such a manner that it is easily withdrawn towards the interspace 9 as the distal end surface is abutted against an object material to be stippled in accordance with the pushing force.

The rear end opening of the proximal end portion 1*a* of the main body 1 is closed with a breech block 11, and thus the ink storage chamber within the proximal end portion 1*a* is air-tightly retained. Further, a detachable cap 12 is detachably fixed to the front portion of the main body 1 so as to cover the stippling member 7.

Figure 2:
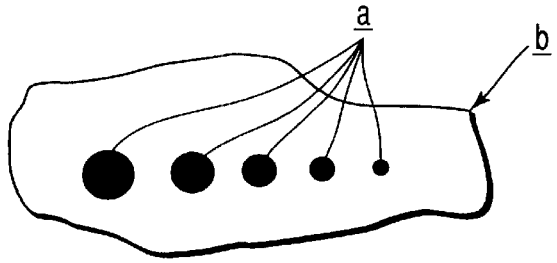
FIG. 2 is a plan view showing various stippled marks, that is, dots, obtained with the stippling instrument shown in FIG. 1.

In the stippling instrument having the above-described structure, ink impregnated in the ink holding member 5 within the ink storage chamber permeates to the stippling member 7 via the ink transfer member 3 due to the capillary action. With this instrument of the above-described structure, a drawer detaches the cap 12 from the main body 1, and holds the proximal end portion 1*a* of the main body 1. Then, the drawer places the outer surface (stippling surface) of the distal end portion 7*b* with pressure on an object material b (FIG. 2) on which stippling is carried out, such as Japanese paper or regular machine-made paper, and thus ink is supplied onto the object material from the distal end portion to make a point mark or dot on the object material. Further, depending on the amount of consumption or flow-out of ink from the stippling member, ink is supplied continuously or intermittently from the ink storage chamber to the stippling member via the ink transfer member due to the capillary action, and thus the stippling can be continuously carried out. While stippling, when the pressure force (the strength of stippling stroke) for pushing the distal end portion onto the object material b is varied as desired, point marks having difference sizes according to the strengths of strokes can be formed on the object material b as shown in FIG. 2. The distal end portion abutted on the object material b deforms elastically towards the cavity 9 depending on the strength of the stroke, and therefore an ink amount per unit area becomes constant regardless of the size of the point mark a. In FIG. 2, the sizes of the point marks a increase gradually from right to left, and it can be easily understood that these marks indicate that the strength of the stroke is increased as shown. In this embodiment, the dimensions and softness of the stippling member 7 are set so as to be able to change the size of the point mark arbitrarily within a range of 1.5 to 6.5 mm in diameter; however the setting can be changed as desired.

Figure 3:
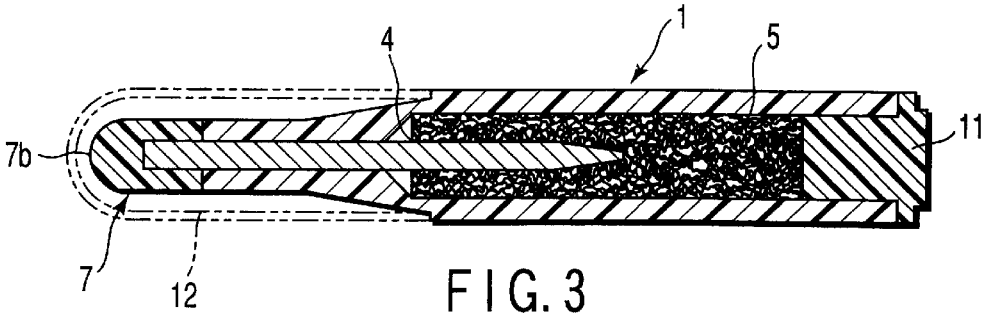
FIG. 3 is a cross-sectional view showing a stippling instrument according to the first embodiment of the present invention.

Next, the stippling instrument according the second embodiment of the present invention will now be described with reference to FIG. 3. In this embodiment, structural members substantially similar to those already discussed in the previous embodiment will be designated by the same reference numerals, and their explanations will not be repeated.

In this embodiment, the distal end portion 7*b* projecting forwards to have a curvature from the cylindrical stippling member 7 is formed to have a thicker thickness, and the inner surface of the distal end portion is made flat to be brought into contact with the front surface of the ink transfer member 3. With this structure, ink can be supplied from the transfer member 3 to the stippling member 7 not only through the circumferential portion of the stippling member but also greatly through the inner surface of the distal end portion, and therefore the impregnation of ink to the distal end portion can be stabilized.

In this embodiment, the distal end portion 7*b* of the stippling member 7 is compressed while stippling in accordance with the stroke pressure. In this manner, stippling marks of various sizes can be formed as in the case of the first embodiment. The stippling instrument of this embodiment has such a tendency as compared to that of the first embodiment that the flow-out amount of ink from the distal end portion 7*b* of the stippling member 7 is increased when the stroke pressure is strong. In this case, a larger stippling mark is deeper in color density than a smaller mark. With use of this type of the drawing instrument, a stippling image of a different touch from that of the before-described embodiment can be obtained. The degree of change in the density of the ink in accordance with the size of a mark can be adjusted variously by changing the thickness of the distal end portion of the stippling member.

In both of the first and second embodiments, the curved front surface (stippling surface) of the distal end portion of the stippling member 7 has a continuous partial spherical surface; however the present invention is not limited to this structure, but the front surface of the distal end portion may be an non-continuous partial spherical surface having cavities of various shapes such as a slit, slot, groove and cut formed in the surface.

Figure 4:
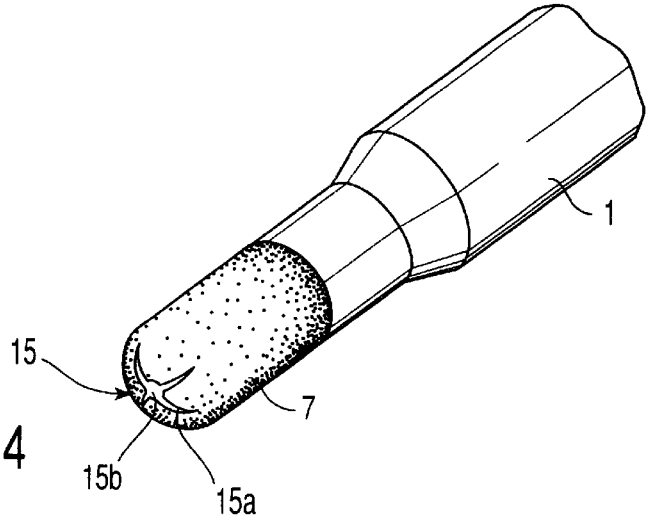
FIG. 4 is a perspective view showing a modification of a distal and portion of the stippling instrument according to the first embodiment of the present invention.
Figure 5A:
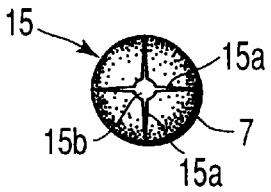
FIGS. 5A and 5B are, respectively, a plan view and side view showing a soft elastic member provided at the distal end portion shown in FIG. 4.
Figure 6A:
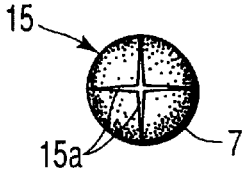
FIGS. 6A, 6B, 7A, 7B, 8A and 8B are plan views and side views respectively showing different versions of the soft elastic member, which have different cavities formed therein.
Figure 7A:
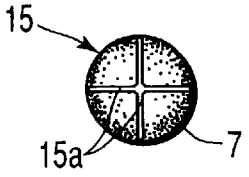
Figure 8A:
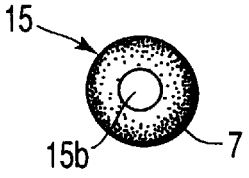
Figure 5B:
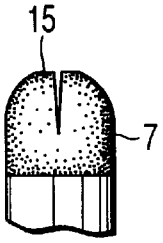
Figure 6B:
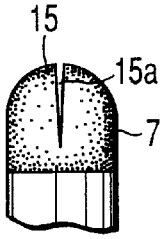
Figure 7B:
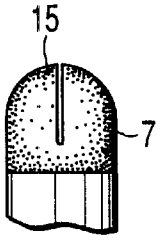
Figure 8B:
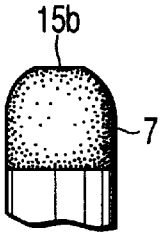
Figure 9:
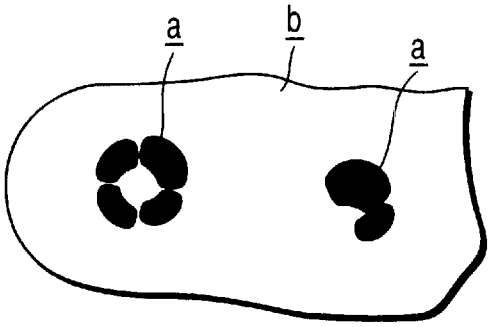
FIG. 9 is a diagram showing dots stippled with a writing instrument with an elastic member in which a cavity is made.

For example, the curved front surface of the stippling member 7 shown in FIGS. 4, 5A and 5B, has a cavity section 15 made of a cross-shaped slit made of two straight slits 15*a* crossed with each other at center, and a round hole 15*b* perforated at the center. The cavity section is made through the front surface of the distal end portion of the stippling member to its rear surface. The straight slits are formed such that they become narrower towards the ends from the center of the surface as shown in these figures. An example shown in FIGS. 6A and 6B is the same as that shown in FIGS. 5A and 5B except that a round hole is not formed at the center. An example shown in FIGS. 7A and 7B is the same as that shown in FIGS. 6A and 6B except that the width of each straight slit 15*a* is constant over its entire length. In an example shown in FIGS. 8A and 8B, a round through hole 15*b* or a round recessed cut is made at the center of the curved front surface of the stippling member 7. FIG. 9 shows examples of marks (dots) a stippled on an object material b with the drawing instrument having a stippling member having such a cavity section made therein. It should be obvious here that the shape and size of the dot can be variously changed by selecting a desired one from various shapes of the cavity section and stroke pressures. The shapes of the cavity sections described with reference to the above figures are merely examples, and therefore the present invention is not limited to these.

In the above-described embodiments, the ink holding member made of a filling material impregnated with ink is put in the ink chamber of the main body so as to be able to supply ink to the ink transfer member; however as long as ink can be supplied to the transfer member, the structure of this mechanism is not limited to those discussed in the embodiments. For example, it is possible to consider such a structure in which ink may be directly reserved in the ink chamber, and the proximal end of the transfer member is immersed into the ink reservoir. In this case, the transfer member may be a tube through which ink can be transferred. Further, in the above-described embodiments, the stippling member for supplying ink directly to an object material is made to have a cylindrical shape so as to cover the distal end portion of the transfer member; however the present invention is not limited to such a shape. For example, as long as the stippling member is provided on the distal end surface of the transfer member, it is not necessarily made to have a cylindrical shape. In such a case, the stippling member may be made integral with the transfer member, or these members may be connected together by any means.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A stippling tool comprising:

a cylindrical main body having an opening on a distal end side thereof, and defining an ink containing chamber therein;

a slender ink transfer member having a proximal end portion to which ink in the ink containing chamber is supplied, and a distal end portion extending to the opening of the main body, in which ink is transferred from the proximal end portion to the distal end portion; and a porous elastic stippling member provided on the distal end portion of the ink transfer member, through which the ink permeates;

the stippling member having a stippling distal end surface outwardly projecting in a curved shape, and located outside from the opening of the main body, the distal end surface being elastically deformed by a stroke pressure, thereby stippling a point mark of dimensions in accordance with the stroke pressure onto an object material, wherein the stippling member has a cylindrical circumferential portion enclosing the distal end portion of the ink transfer member such as to be in contact therewith and having an opening at both ends, and a distal end portion which closes the opening on the distal end side of the circumferential portion and includes the stippling end surface.

2. A stippling instrument according to claim 1, further comprising: a filling material impregnated with ink, which is contained in the ink containing chamber, the proximal end portion of the ink transfer member being inserted into the filling material.

3. A stippling instrument according to claim 1, wherein the ink transfer member is made of a transfer material through which ink transferred due to capillary action.

4. A stippling instrument according to claim 1, wherein the distal end portion of the stippling member has an inner surface, and the ink transfer member has a distal end surface formed distant from the inner surface of the distal end portion of the stippling member, so as to create an interspace between itself and the inner surface.

5. A stippling instrument according to claim 4, wherein a thickness of the distal end portion of the stippling member is made thinner than that of the circumferential portion.

6. A stippling instrument according to claim 1, wherein the distal end portion of the stippling member has an inner surface, and the ink transfer member has a distal end surface brought into contact with the inner surface of the distal end portion.

7. A stippling instrument according to claim 6, wherein a thickness of the distal end portion of the stippling member is made thicker than that of the circumferential portion.

8. A stippling instrument according to claim 1, wherein the distal end surface of the stippling member is a continuous partial spherical surface.

9. A stippling instrument according to claim 1, wherein the distal end surface of the stippling member is a non-continuous partial spherical surface having a cavity.

10. A stippling instrument according to claim 9, wherein the cavity of the distal end surface has a cross shape.

11. A stippling instrument according to claim 9, wherein the cavity of the distal end surface has a round cut section made at a center of the distal end surface.

* * * * *

UNITED STATES PATENT AND TRADEMARK OFFICE

CERTIFICATE OF CORRECTION

PATENT NO. : 6,439,793 B1
DATED : August 27, 2002
INVENTOR(S) : Ichiro Nishitani et al.

It is certified that error appears in the above-identified patent and that said Letters Patent is hereby corrected as shown below:

Title page,
Item [30], Foreign Application Priority Data, "2000-137928" should read -- 2001-137928 --.

Signed and Sealed this

First Day of July, 2003

JAMES E. ROGAN
*Director of the United States Patent and Trademark Office*